US005454405A

United States Patent [19]

Hawes

[11] Patent Number: 5,454,405

[45] Date of Patent: Oct. 3, 1995

[54] TRIPLE LAYER PAPERMAKING FABRIC INCLUDING TOP AND BOTTOM WEFT YARNS INTERWOVEN WITH A WARP YARN SYSTEM

[75] Inventor: John M. Hawes, Appleton, Wis.

[73] Assignee: Albany International Corp., Albany, N.Y.

[21] Appl. No.: 294,552

[22] Filed: Aug. 23, 1994

Related U.S. Application Data

[63] Continuation-in-part of Ser. No. 252,708, Jun. 2, 1994, abandoned.

[51] Int. Cl.[6] ..... D03D 13/00

[52] U.S. Cl. ..... 139/383 A

[58] Field of Search ..... 139/383 A, 425 A

[56] References Cited

U.S. PATENT DOCUMENTS

| | | | |
|---|---|---|---|
| 3,301,746 | 1/1967 | Sanford et al. . | |
| 4,499,927 | 2/1985 | Borel | 139/383 A X |
| 4,514,345 | 4/1985 | Johnson et al. . | |
| 4,528,239 | 7/1985 | Trokhan . | |
| 4,529,580 | 7/1985 | Trokhan . | |
| 4,564,051 | 1/1986 | Odenthal | 139/383 A |
| 4,637,859 | 1/1987 | Trokhan . | |
| 4,815,503 | 3/1989 | Borel | 139/383 A |
| 4,967,805 | 11/1990 | Chiu et al. | 139/383 A |
| 5,052,448 | 10/1991 | Givin | 139/383 A |
| 5,114,777 | 5/1992 | Gaisser | 139/383 A X |
| 5,152,326 | 10/1992 | Vohringer | 139/383 A |

*Primary Examiner*—Andy Falik

*Attorney, Agent, or Firm*—Kane, Dalsimer, Sullivan, Kurucz, Levy, Eisele & Richard

[57] ABSTRACT

A triple-layer papermaking fabric includes top and a bottom weft yarn layers interwoven with a system of warp yarns. The warp yarn system includes pairs of associated, stacked first and second warp yarns. The first warp yarn in each pair interweaves with the top weft yarns in a plain-weave pattern occasionally broken by an interweaving with a bottom weft yarn to join the top and bottom weft yarn layers together. The second warp yarn in each pair, ordinarily running between the top and bottom weft yarn layers and stacked below the first warp yarn, weaves over the top weft yarn skipped by the first warp yarn when it weaves down under a bottom weft yarn to maintain the plain-weave character of the top surface of the fabric. The second warp yarn never weaves with the bottom weft yarns. The fabric is flat-woven, and subsequently seamed into endless form. The first warp yarns have an exaggerated crimp to provide the fabric with an enhanced seam strength. The second warp yarns, having relatively little crimp, provide the fabric with an enhanced stretch resistance.

33 Claims, 2 Drawing Sheets

TRIPLE LAYER PAPERMAKING FABRIC INCLUDING TOP AND BOTTOM WEFT YARNS INTERWOVEN WITH A WARP YARN SYSTEM

This is a continuation-in-part of application Ser. No. 08/252,708 filed on Jun. 2, 1994, abandoned Jul. 10, 1995.

BACKGROUND OF THE INVENTION

1. Field of the Invention

The present invention relates to papermaking, and, more particularly, to fabric belts used in papermaking. Specifically, the present fabric belts are of the variety used to mold fibers into a three-dimensional structure, and, when so used, reduce non-uniform fiber distribution, pinholes and other irregularities frequently observed during such manufacturing processes.

2. Description of the Prior Art

Cellulosic fiber structures, such as newspaper, cardboard boxes, paper towels, facial tissues and toilet tissues, are a staple of contemporary life. The large demand for and constant use of such consumer products has created a need for improved versions thereof, and for improvements in their methods of manufacture. Such cellulosic fiber structures are manufactured by depositing an aqueous slurry from a headbox onto a Fourdrinier wire or between the wires on a twin wire paper machine. In either case, the forming wire is an endless fabric belt through which initial dewatering occurs and on which fiber rearrangement takes place. Frequently, fiber loss occurs when fibers flow through the forming wire along with the liquid carrier from the headbox.

After the initial formation of the web, which later becomes the cellulosic fiber structure, the web is transported to the dry end of the machine. In the wet end of a conventional machine, a press felt compacts the web into a single region cellulosic fiber structure prior to final drying. The final drying is usually accomplished by a heated drum, such as a Yankee drying drum.

In an improved manufacturing method, which yields corresponding improvements in the consumer products being manufactured, through-air drying replaces conventional press felt dewatering. In through-air drying, as in press felt dewatering, the web is initially formed on a forming wire which receives an aqueous slurry of less than one percent consistency (that is, the weight percent of fibers in the slurry is less than one percent) from a headbox. Initial dewatering takes place on the forming wire, but the web usually does not attain a consistency greater than 30 percent on the wire. From the forming wire, the web is transferred to an air-pervious through-air-drying belt.

Air passes through the web and through the through-air drying belt to continue the dewatering process. The air is driven by vacuum transfer slots, other vacuum boxes or shoes, predryer rolls, and other components. This air molds the web to the topography of the through-air-drying belt and increases the consistency of the web. This molding creates a more three-dimensional web, but also causes pinholes when the fibers in the web are deflected so far in a direction perpendicular to the plane of the through-air-drying belt that a breach in fiber continuity occurs.

After the web is molded on the through-air-drying belt, it is transported to the final drying stage, where it may also be imprinted. At the final drying stage, the through-air-drying belt transfers the web to a heated drum, such as a Yankee drying drum, for final drying. During this transfer, portions of the web may be densified in a specific pattern by imprinting to yield a multi-region structure. Paper products having such multi-region structures have been widely accepted by consumers. An early through-air-drying belt, which created a multi-region structure in the web by imprinting the knuckle pattern of its woven structure thereon, is shown in U.S. Pat. No. 3,301,746.

A subsequent improvement in through-air-drying belts was the inclusion of a resinous framework on the woven structure of the belt. Through-air-drying belts of this type may impart continuous or discontinuous patterns in any desired form, rather than knuckle patterns, onto the web during imprinting. Through-air-drying belts of this type are shown in U.S. Pat. Nos. 4,514,345; 4,528,239; 4,529,480; and 4,637,859.

The woven structure and the resinous framework of through-air-drying belts of this type provide mutual reinforcement for each other. The woven structure also controls the deflection of the papermaking fibers which results from vacuum applied to the backside of the belt and airflow through the belt. In early belts of this type, the woven structure was of a single-layer fine mesh, typically having approximately fifty machine-direction and fifty cross-machine-direction yarns per inch. While such a fine mesh was acceptable from the standpoint of controlling fiber deflection into the belt, it could not stand up to the environment of a typical papermaking machine for several reasons. One reason was that the fine mesh was so flexible that destructive folds and creases often occurred. In addition, the fine yarns did not provide adequate seam strength, and would often burn at the high temperatures encountered in papermaking.

Through-air-drying fabrics for the most part have been flat-woven, and subsequently joined into endless form with a woven seam. In general, there is a trade-off in flat-woven fabrics between seam strength and stretch resistance. This trade-off is controlled by the crimp in the warp yarns, which become the machine-direction yarns in a flat-woven fabric. In through-air-drying belts, which have a high open area (HOA), the trade-off is quite sensitive. In other words, as warp crimp is reduced to provide a fabric with more stretch resistance, seam strength will suffer, and vice versa. The balance between seam strength and stretch resistance is even more sensitive in an HOA fabric than in a more densely woven fabric, because there are relatively fewer warp yarns per unit of width in such a fabric.

Another problem, particularly encountered in tissue making, is the formation of small pinholes in the deflected areas of the web. It has recently been learned that pinholes are strongly related to the weave configuration of the woven structure in a through-air-drying belt.

A woven structure recently used for through-air-drying fabrics is a dual layer design having vertically stacked warps. A single weft yarn system ties the vertically stacked warps together. Generally, the conventional wisdom has been to use relatively large diameter yarns to increase fabric life. Fabric life is important not only because of their cost, but more importantly because of the expensive downtime incurred when a worn fabric must be removed from a papermachine and a new one installed. Larger diameter yarns, while being more durable, require larger holes between each other to accommodate the weave. The larger holes permit short fibers, such as those of Eucalyptus, to be pulled through the fabric and thereby create pinholes. Products made with such short fibers are heavily preferred by consumers because of the softness the short fibers impart to a cellulosic fiber structure.

This problem can be solved by weaving more yarns per inch into the pattern. However, this approach reduces the open area available for air flow. If yarns of smaller diameter are used to reopen the open area, the flexural rigidity and integrity of the woven structure of the belt are compromised and the fabric life is thereby reduced. Accordingly, the prior art also required a trade-off between the necessary open area (for airflow) and fiber diameter (for pinholing and belt life).

One attempt to achieve both good fiber support, and the flexural rigidity and belt integrity necessary to achieve a viable belt life, was to use a combination of large and small machine-direction (warp) yarns. The large diameter yarns provide the fabric with durability, and the smaller diameter machine-direction (warp) yarns are stacked above them on the web-facing layer for fiber support and pinhole reduction. An additional smaller diameter machine-direction (warp) yarn was placed on the paper-supporting side of the fabric between each stacked pair of machine-direction (warp) yarns for added fiber support. This attempt still did not satisfactorily reduce the occurrence of pinholes because the woven structure lacked planarity in that the additional machine-direction yarns were not supported from below by another yarn and tended to sag. The sagging leads to an increase in pinholing in the paper product being manufactured. In addition, the cross-machine-direction (weft) yarns which tied the two layers together went from the top of the paper-supporting layer to the bottom of the machine-contacting layer. This caused a further deviation from planarity which also contributed to increased pinholing.

The solution to these problems is one which recognizes that pinholing in a through-air-drying belt and fiber loss in a forming wire are related to the yarns that support the fibers, rather than to the open spaces between the yarns. The web-facing yarns must remain close to the top plane of the paper-supporting layer to provide adequate fiber support. In addition, the weave pattern must accommodate large diameter yarns in order to provide adequate fabric life.

Accordingly, it is an object of the present invention to provide a forming wire and a through-air-drying fabric which reduce non-uniform fiber distribution and pinholes in the product being manufactured. It is also an object of the present invention to provide a forming wire and a through-air-drying fabric in which the trade-off between seam strength and stretch resistance is balanced.

SUMMARY OF THE INVENTION

The present invention is a triple-layer papermaking fabric which has a structure which provides the planarity required to minimize non-uniform fiber distribution and the occurrence of pinholes while providing high permeability at the same time as balancing the trade-off between seam strength and stretch resistance.

In its broadest form, the triple-layer papermaking fabric comprises a system of top weft yarns and a system of bottom weft yarns interwoven with a system of warp yarns. The latter comprises paired and preferably stacked first and second warp yarns, each of which has its own function. Together, however, the first and second warp yarns provide the top, paper-supporting surface of the fabric with the appearance and character of a single-layer fabric woven in a preferably plain-weave pattern.

The present invention is being called a triple-layer papermaking fabric to be consistent with current industry terminology. Current state of the art, or industry knowledge, regards single-layer fabrics as having one warp system and one weft system. Two-layer fabrics consist of one warp system, and two or more weft systems that alone comprise independent forming and wear sides. Three-layer fabrics have been commonly accepted as having at least two different warp systems, and at least two different weft systems with independent forming and wear sides. Because the present invention most closely falls into the last category, it is being called a triple-layer papermaking fabric.

The first warp yarn in each such pair interweaves with the top weft yarns in a repeating pattern, preferably a plain-weave pattern, and occasionally weaves with a bottom weft yarn to bind the top and bottom weft yarn layers together. The occasional interweaving of the first warp yarn with the bottom weft yarn also provides the first warp yarn with an exaggerated crimp which improves the woven-seam strength of the triple-layer papermaking fabric.

The second warp yarn in each said pair interweaves only with the top weft yarns, and is otherwise disposed between the top and bottom weft yarn layers, preferably stacked below the first warp yarn with which it is paired. That is to say, more specifically, the second warp yarn never weaves below a bottom weft yarn. Further, the second warp yarn in each pair weaves over only those top weft yarns skipped by the first warp yarn when it weaves down to bind a bottom weft yarn. This maintains the uniformity of the weave pattern, preferably a plain-weave pattern, of the top surface of the fabric. In addition, the second warp yarn in each pair has relatively little crimp. This improves the stretch resistance of the fabric.

The plain-weave character of the top surface of the present triple-layer papermaking fabric provides it with the planarity required to minimize the occurrence of non-uniform fiber distributions and of pinholes. The top surface is formed by the interweaving of the first and second warp yarns and the top weft yarns, and comprises knuckles formed when the yarns wrap over one another. The knuckles define a paper-supporting top surface. The planarity may be quantified in the following terms: each yarn on the top surface has a top dead center longitude, which remains within 1.5 yarn diameters of the plane defined by the knuckles, and preferably within 1.0 yarn diameters of that plane. The fabric has a thickness at least 2.5 times as great as the yarn diameter.

The present invention will now be described in more complete detail with frequent reference being made to the figures to be identified as follows.

DETAILED DESCRIPTION OF THE PREFERRED EMBODIMENT

Figure 1:
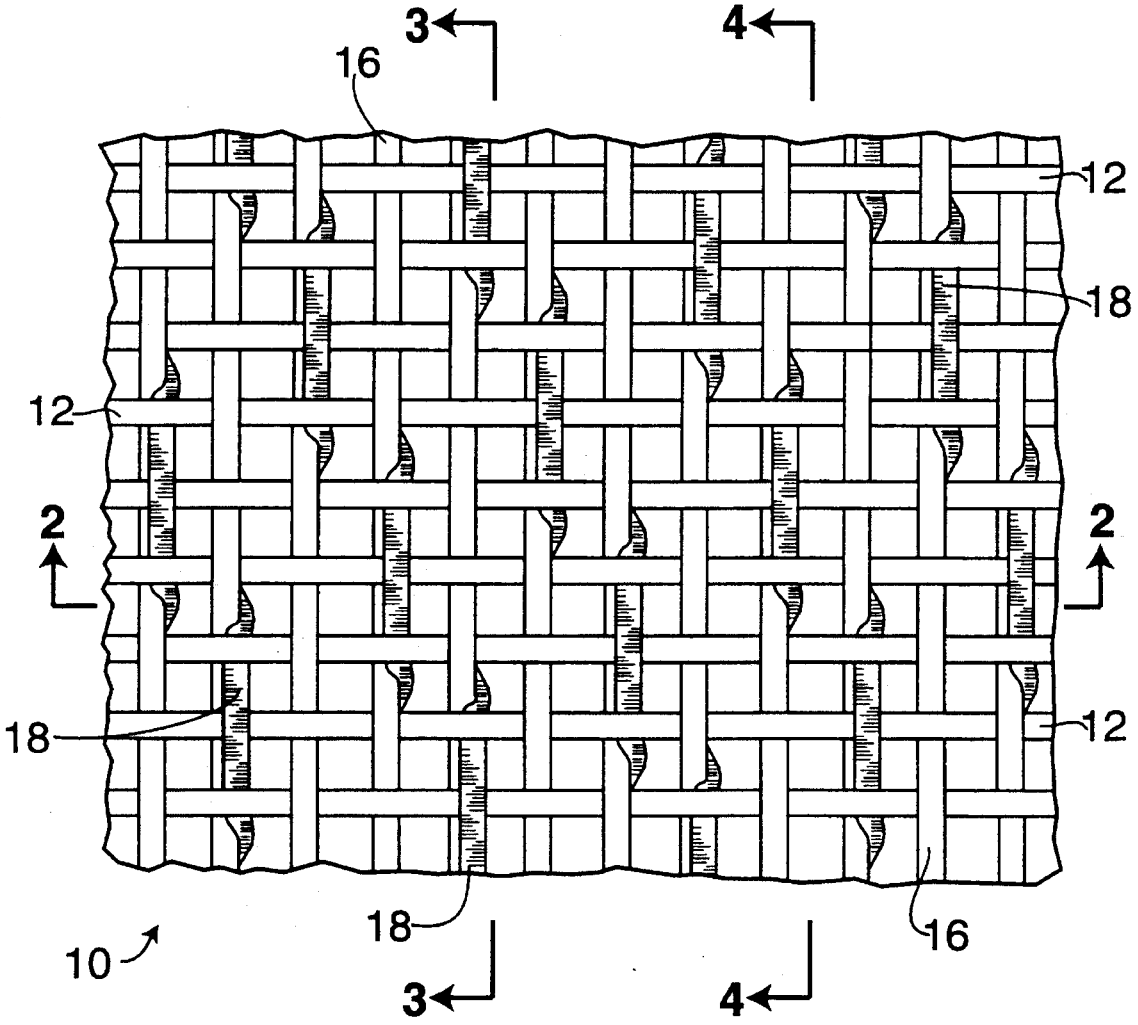
FIG. 1 is a top plan view showing the paper side of a fabric according to the present invention.

Turning first to the figures identified above, FIG. 1 is a top plan view showing the paper side of the fabric 10 of the present invention. As viewed in FIG. 1, the paper side of fabric 10 has the appearance of a single layer fabric woven in a plain weave. The paper side is formed by interwoven warp and weft yarns of the fabric 10. The warp yarns lie in the machine direction, and the weft yarns lie in the cross-machine direction. The fabric 10 is flat-woven, and subsequently seamed into endless form with a woven seam, although it may be woven endless. In the latter case, the orientations of the warp and weft yarns with respect to the directions on the papermachine would be the reverse of that stated above for a flat-woven fabric.

The weave pattern for fabric 10, however, has been specifically devised for the case where the fabric 10 is to be flat-woven, and later seamed into endless form with a woven seam. With reference to FIG. 3, which is a cross-sectional view of the fabric 10 taken in the machine direction as indicated by line 3—3 in FIG. 1, the fabric 10 may be observed to comprise two layers of weft yarns. The top weft yarns 12 are disposed on the paper side of fabric 10, while the bottom weft yarns 14, not shown in FIG. 1, are disposed on the wear side of fabric 10. Weft yarns 12,14 may be provided in a 2:1 ratio, there being two weft yarns 12 in the top layer for every weft yarn 14 in the bottom layer. Alternate weft yarns 12 may be in a vertically stacked relationship with weft yarns 14. In addition, as suggested by the relative diameters of weft yarns 12,14 shown in FIG. 3, as well as in FIGS. 2 and 4, weft yarns 14 may be of larger diameter than weft yarns 12 to enhance the durability of fabric 10.

The top weft yarns 12 and bottom weft yarns 14 are interwoven by a system of warp yarns comprising paired and preferably stacked first and second warp yarns. The first warp yarn 16 interweaves with the top weft yarns 12 and with the bottom weft yarns 14 in a repeating pattern such that it weaves alternately over and under six consecutive top weft yarns 12 in a plain-weave pattern, then weaves under the next bottom weft yarn 14, and then weaves up over the next top weft yarn 12 to repeat the pattern. This repeating pattern is illustrated in both FIGS. 3 and 4, the latter of which is a cross-sectional view of the fabric 10 taken in the machine direction as indicated by line 4—4 in FIG. 1. It will be noted in both FIGS. 3 and 4 that, because first warp yarn 16 weaves over the alternate top weft yarns 12 which are not stacked above bottom weft yarns 14, an exaggerated crimp 20 is placed upon first warp yarn 16 when it weaves up from under a bottom weft yarn 14 and over the next top weft yarn 12. In other words, the interweaving of first warp yarn 16 with bottom weft yarn 14 to join the two layers of weft yarns 12,14 together is non-symmetric in that the upward crimp is steeper than the downward crimp. The resulting exaggerated crimp 20 is responsible for the increased seam strength in the fabrics 10 of the present invention.

A second warp yarn 18 interweaves only with the top weft yarns 12. Second warp yarns 18 are provided in pairs with the first warp yarns 16 and weave over those alternate top weft yarns 12 which the first warp yarn 16 does not weave over on the occasions when it is weaving underneath a bottom weft yarn 14. Second warp yarns 18, then, weave over a top weft yarn 12, and then under the next seven consecutive top weft yarns 12 in a repeating pattern, without ever weaving below a bottom weft yarn 14. As a consequence, second warp yarns 18 never pass to the wear side of the fabric 10 even though they are stacked below the first warp yarns 16 for up to 75% of their lengths. Most importantly, second warp yarn 18 weaves over top weft yarn 12 at points where first warp yarn 16 is weaving under bottom weft yarn 14 to maintain the plain-weave character of the paper side of fabric 10 and the planarity required to reduce or eliminate the presence of pinholes. Further, second warp yarn 18, having a minimal amount of crimp by virtue of its running for approximately 88% of its length straight between the top weft yarns 12 and the bottom weft yarns 14, is responsible for the increased stretch resistance in the fabric 10 of the present invention.

Figure 3:
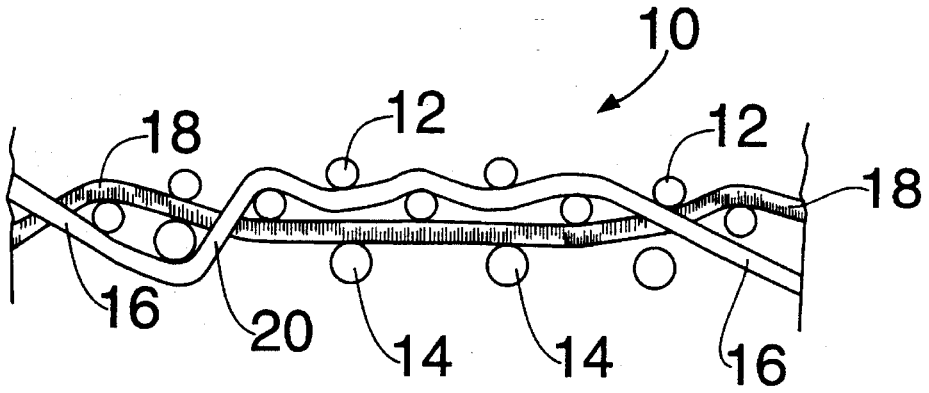
FIG. 3 is a cross-sectional view of the fabric taken in the machine direction as indicated by line 3—3 in FIG. 1.
Figure 4:
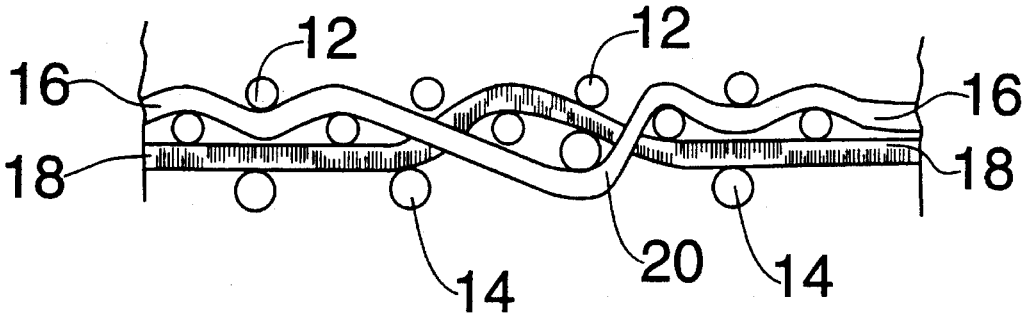
FIG. 4 is a cross-sectional view of the fabric also taken in the machine direction as indicated by line 4—4 in FIG. 1.

It will be noted that, for the purposes of illustration, second warp yarns 18 have been shaded in FIGS. 3 and 4. Referring back to FIG. 1, a top plan view of the paper side of fabric 10, the knuckles produced there by second warp yarns 18 have been similarly shaded. Viewing along any given warp contour, every fourth knuckle is produced by a second warp yarn 18. The plain-weave character of the paper side of the fabric 10 is readily apparent in the figure.

The present invention has been described as a triple-layer papermaking fabric. Such a description implies that there is a middle layer in addition to the layers defined by the top weft yarns 12 and the bottom weft yarns 14.

The middle layer 22 of the present invention may be described as the plane obtained perpendicular to the thickness direction where the "transition" warp sections reside. "Transition" warp sections are those portions below the plane defined by the bottom of the top weft yarns 12, or by the bottom of a warp yarn 16 when it is only interlacing a top weft yarn 12, or above the plane defined by the top of the bottom weft yarns 14, or by the top of a warp yarn 16 when it is only interlacing a bottom weft yarn 14. These planes are indicated by dashed lines in FIGS. 3 and 4. The space between them is the middle layer 22.

A "transition" warp section is the phase of the warp where it changes from primarily a forming side interlacer to a wear side interlacer, and/or from primarily a wear side interlacer to a forming side interlacer.

It will be observed in FIGS. 3 and 4 that second warp yarn 18 resides for most of its length in the middle layer 22.

Figure 2:
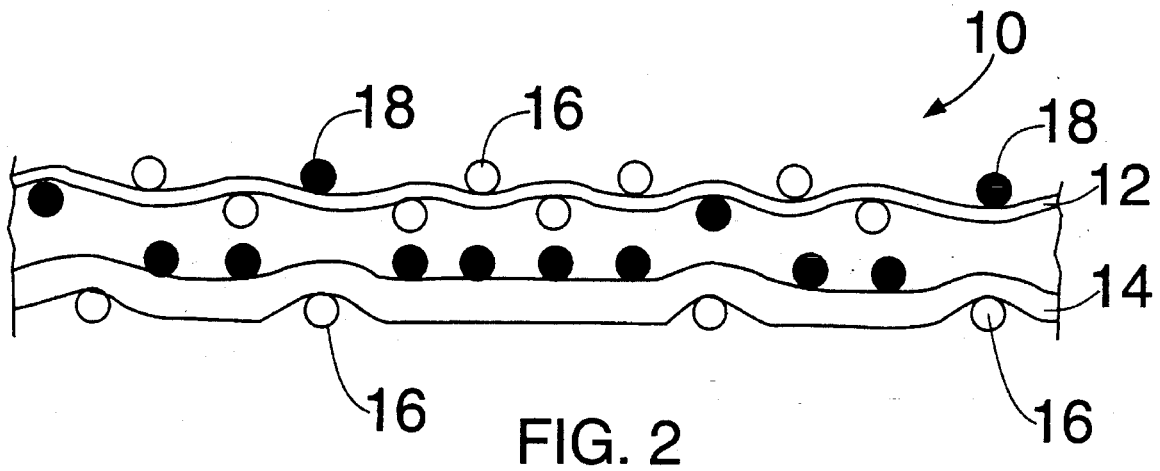
FIG. 2 is a cross-sectional view of the fabric taken in the cross-machine direction as indicated by line 2—2 in FIG. 1.

FIG. 2 is a cross-sectional view of the fabric 10 taken in the cross-machine direction as indicated by line 2—2 in FIG. 1. It may be observed that the first warp yarn 16 and the second warp yarn 18 in each pair are in a vertically stacked relationship, which is their preferred, but not required, relationship with respect to each other. The second warp yarns 18 are represented as black dots solely for the purposes of illustration. It may be seen that second warp yarns 18 maintain the plain-weave character, or planarity, of the paper side of fabric 10 at those points where first warp yarn 16 weaves under bottom weft yarn 14.

Referring back to FIG. 1, along any given warp contour the knuckles formed by second warp yarns 18 may be displaced slightly weft-wise, or in a cross-machine direction, from exact alignment with those formed by first warp yarns 16. This may occur because first warp yarn 16 and second warp yarn 18 must pass by one another from their usual stacked relationship when first warp yarn 16 weaves down to bottom weft yarn 14. As shown in FIG. 1, the knuckles formed by second warp yarns 18 are displaced slightly to the right from exact alignment with those formed by the first warp yarns 16 with which they are paired. The displacement may also be to the left, or it may alternate between left and right. The placement of the knuckles formed by second warp yarns 18 relative to those formed by first warp yarns 16 may be varied by weave timing or thread-in practices obvious and well-known to those of ordinary skill in the art.

Fabric 10 of the present invention, as previously implied, is preferably flat-woven, and subsequently seamed into endless form, so that the first warp yarns and second warp yarns may provide fabric 10 with the enhanced seam strength and stretch resistance provided by those respective yarns. The fabric 10 may receive cellulosic fibers discharged from a headbox or carry a web of cellulosic fibers to a drying apparatus, typically a heated drum, such as a Yankee drying drum. Thus, the fabric may either be executed as a forming wire, a press felt, or as a through-air-drying belt to which a resinous imprinting layer may be added.

The paper side of fabric 10 is woven so that the top dead center longitude TDC of each yarn 12,16,18 does not extend more than 1.5 yarn diameters, and preferably not more than 1.0 yarn diameters, below the surface at any position, and remains within 1.5 yarn diameters, and preferably 1.0 yarn diameter, of the surface at all positions, except where first warp yarn 16 weaves beneath bottom weft yarn 14. The yarn diameter in question is based on the diameters of the yarns 12,16,18. If yarns 12,16,18 having different diameters are utilized, the yarn diameter is the diameter of the largest yarn among yarns 12,16,18. If yarns 12,16,18 having a non-round cross section are used, the yarn diameter is considered to be the maximum dimension through such yarn 12,16,18 taken perpendicular to the plane of the fabric 10. The top dead center longitude TDC of a yarn is that line parallel to the longitudinal axis of the yarn and disposed on the surface thereof at a position closest to the paper side of the fabric 10. The discussion in this paragraph sets forth the manner in which the planarity of fabric 10 may be quantified.

The fabric 10 according to the present invention has a thickness at least 2.5 times as great as one yarn diameter, as defined above, and more preferably at lest 3.0 times as great as one yarn diameter. Such a thickness is important in providing sufficient belt rigidity so that belt life is not unduly compromised.

The thickness of the fabric 10 is measured at 70° F. to 75° F. using an Emveco Model 210A digital micrometer made by the Emveco Company of Newburg, Oreg., or a similar apparatus, using a 3.0 pounds per square inch loading applied through a round 0.875 inch diameter foot. The fabric 10 may be loaded up to a maximum of 20 pounds per linear inch in the machine direction while tested for thickness. The fabric 10 must be maintained at 50° F. to 100° F. during testing.

The fabric 10 of the present invention must allow sufficient air flow perpendicular to the plane thereof. The fabric 10 has an air permeability of from 200 standard cubic feet per minute per square foot to 1,500 standard cubic feet per minute per square foot. The air permeability of the fabric 10 is measured under a tension of 15 pounds per linear inch using a Frazier Permeability Tester at a differential pressure of 0.5 inches $H_2O$. If any portion of the fabric 10 meets the aforementioned air permeability limitations, the entire fabric is considered to meet these limitations.

As implied above, yarns having non-round cross sections may be used to weave the fabric 10 of the present invention. In addition, the bottom weft yarn 14 may be of larger diameter than the top weft yarn 12. First warp yarn 16 and second warp yarn 18 may be of non-round cross section, but, in any event, would preferably have the same diameter. First warp yarn 16 and second warp yarn 18 do not necessarily have to have the same diameter as top weft yarn 12, although it may be preferred that they have the same diameter.

Where the fabric 10 is to be used as a through-air-drying belt, perhaps including a resinous imprinting layer, it is preferred that the yarns be of polyester having hydrolysis-resistant additives. On the other hand, where the fabric 10 is to be used in a purely forming application, polyamide yarns may be used in the weaving thereof, particularly as the bottom weft yarns 14 to obtain the benefit of polyamide's resistance to wear and abrasion. In general, fabric 10 may be woven from yarns extruded from any synthetic resin extrudable in monofilament form, the specific resin to be used being governed by the application or end use of the fabric 10.

In the preceding discussion, and as illustrated in FIGS. 1 through 4, it has been assumed the top weft yarns 12, bottom weft yarns 14, first warp yarns 16 and second warp yarns 18 are monofilament yarns. However, multifilament and plied monofilament yarns may be used as weft yarns, particularly as top weft yarns 12 where they could enhance the planarity of the paper side of the fabric 10.

While the weave pattern shown in FIGS. 1 through 4 is preferred in the production of fabric 10 because its plain-weave character provides the high level of surface planarity required to minimize the occurrence of pinholes and because of the balance it achieves in the trade-off between seam strength and stretch resistance, one skilled in the art might vary the weave pattern without departing from the scope of the appended claims by weaving a fabric having top and bottom weft yarns interwoven by a first warp yarn, which ties the weft yarns together, and including a second warp yarn associated therewith which does not bind with the bottom weft yarns, but weaves with the top weft yarns at such points where the first warp yarn associated in a preferably stacked pair therewith weaves with a bottom weft yarn.

EXAMPLE

A fabric 10 woven according to the pattern shown in FIGS. 1 to 4 is flat-woven with 90 warp strands per inch, of which 45 per inch are first warp yarns 16 and 45 per inch are second warp yarns 18 in stacked pairs therewith. There are 60 to 80 weft strands per inch, two thirds of which are top weft yarns 12 and one third of which are bottom weft yarns 14. Weft yarns 12,14 are in a 2:1 ratio, alternate top weft yarns 12 being vertically stacked above bottom weft yarns 14.

The fabric 10 is subsequently seamed into endless form, the warp yarns thereby becoming longitudinal, or machine-direction, yarns, and the weft yarns becoming transverse, or cross-machine direction, yarns.

The first warp yarns 16 and second warp yarns 18 are polyester monofilaments of a round cross section having a 0.15 mm diameter. The top weft yarns 12 and bottom weft yarns 14 are polyester monofilaments of round cross sections having 0.15 mm and 0.20 mm diameters, respectively. Where fabric 10 has been woven with 72 weft strands per inch, it has an open area of 52.6%.

The air permeability of the fabric 10 is from 1075 to 1175 cubic feet per square foot per minute at 0.5 inches $H_2O$ measured by a Frazier Permeability Tester under a tension of 15 pounds per linear inch. The caliper, or thickness, of the fabric 10 is from 0.0248 to 0.0264 inches when measured with an Emveco Model 210A digital micrometer under the conditions described above.

As mentioned above, modifications to the present invention would be obvious to those of ordinary skill in the art, yet would not bring the invention so modified beyond the scope of the appended claims.

What is claimed is:

1. A triple-layer papermaking fabric comprising:

a system of top weft yarns and a system of bottom weft yarns; and a system of warp yarns having pairs of first and second warp yarns, said first warp yarns interweaving with said top weft yarns and occasionally binding said bottom weft yarns to said top weft yarns in a repeating pattern, and said second warp yarns interweaving with said top weft yarns by running between said top weft yarns and said bottom weft yarns to form a middle layer and by binding with said top weft yarns at points where their paired first warp yarns weave with said bottom weft yarns, said second warp yarns not interweaving with said bottom weft yarns, wherein said top weft yarns, and said first and second warp yarns form a top surface of said triple-layer papermaking fabric, wherein said first warp yarn in each of said pairs of first and second warp yarns is vertically stacked over its respective second warp yarn except at points where said second warp yarn weaves over a top weft yarn.

2. A triple-layer papermaking fabric as claimed in claim 1 wherein said bottom weft yarns have a greater diameter than said top weft yarns.

3. A triple-layer papermaking fabric as claimed in claim 1 wherein said first and second warp yarns have the same diameter.

4. A triple-layer papermaking fabric as claimed in claim 1 wherein said first and second warp yarns have a non-round cross section.

5. A triple-layer papermaking fabric as claimed in claim 1 wherein said bottom weft yarns have a non-round cross-section.

6. A triple-layer papermaking fabric as claimed in claim 1 wherein said top weft yarns have a non-round cross section.

7. A triple-layer papermaking fabric as claimed in claim 1 wherein said first and second warp yarns and said top weft yarns have the same diameter.

8. A triple-layer papermaking fabric as claimed in claim 1 wherein said top weft yarns, said bottom weft yarns, said first warp yarns and said second warp yarns are monofilament yarns.

9. A triple-layer papermaking fabric as claimed in claim 1 wherein said top weft yarns are plied monofilament yarns.

10. A triple-layer papermaking fabric as claimed in claim 1 wherein said bottom weft yarns are plied monofilament yarns.

11. A triple-layer papermaking fabric as claimed in claim 1 wherein said top weft yarns are multifilament yarns.

12. A triple-layer papermaking fabric as claimed in claim 1 wherein said bottom weft yarns are multifilament yarns.

13. A triple-layer papermaking fabric as claimed in claim 1 wherein said top weft yarns, said bottom weft yarns, said first warp yarns and said second warp yarns are hydrolysis-resistant polyester yarns.

14. A triple-layer papermaking fabric as claimed in claim 1 wherein said top weft yarns, said bottom weft yarns, said first warp yarns and said second warp yarns are polyamide yarns.

15. A triple-layer papermaking fabric as claimed in claim 1 wherein said bottom weft yarns are polyamide yarns.

16. A triple-layer papermaking fabric comprising:

a system of top weft yarns and a system of bottom weft yarns; and a system of warp yarns having pairs of first and second warp yarns, said first warp yarns interweaving with said top weft yarns and occasionally binding said bottom weft yarns to said top weft yarns in a repeating pattern, and said second warp yarns interweaving with said top weft yarns by running between said top weft yarns and said bottom weft yarns to form a middle layer and by binding with said top weft yarns at points where their paired first warp yarns weave with said bottom weft yarns, said second warp yarns not interweaving with said bottom weft yarns, wherein said top weft yarns, and said first and second warp yarns form a top surface of said triple-layer papermaking fabric, wherein there are two yarns in said system of top weft yarns for every one yarn in said system of bottom weft yarns, and wherein alternate yarns in said system of top weft yarns are in a vertically stacked relationship with said yarns in said system of bottom weft yarns.

17. A triple-layer papermaking fabric as claimed in claim 16 wherein said first warp yarns interweave with said top weft yarns in a plain-weave pattern, and wherein said second warp yarns associated therewith interweave with said top weft yarns in a plain-weave pattern at points where said first warp yarns interweave with said bottom weft yarns.

18. A triple-layer papermaking fabric as claimed in claim 16 wherein said first warp yarns weave over and under six consecutive top weft yarns, then weave under the next bottom weft yarn in a repeating pattern and then weave over the next top weft yarn to repeat said pattern, and wherein said second warp yarns weave under seven consecutive top weft yarns and over the next top weft yarn in a repeating pattern, said second warp yarns weaving over top weft yarns skipped by said first warp yarns when said first warp yarns weave with a bottom weft yarn.

19. A triple-layer papermaking fabric as claimed in claim 18 wherein said first warp yarns weave under top weft yarns vertically stacked over said bottom weft yarns, and over alternate top weft yarns not stacked over bottom weft yarns, and wherein said second warp yarns weave over alternate top weft yarns not stacked over bottom weft yarns.

20. A triple-layer papermaking fabric as claimed in claim 16 wherein said bottom weft yarns have a greater diameter than said top weft yarns.

21. A triple-layer papermaking fabric as claimed in claim 16 wherein said first and second warp yarns have the same diameter.

22. A triple-layer papermaking fabric as claimed in claim 16 wherein said first and second warp yarns have a non-round cross section.

23. A triple-layer papermaking fabric as claimed in claim 16 wherein said bottom weft yarns have a non-round cross section.

24. A triple-layer papermaking fabric as claimed in claim 16 wherein said top weft yarns have a non-round cross section.

25. A triple-layer papermaking fabric as claimed in claim 16 wherein said first and second warp yarns and said top weft yarns have the same diameter.

26. A triple-layer papermaking fabric as claimed in claim 16 wherein said top weft yarns, said bottom weft yarns, said first warp yarns and said second warp yarns are monofilament yarns.

27. A triple-layer papermaking fabric as claimed in claim 16 wherein said top weft yarns are plied monofilament yarns.

28. A triple-layer papermaking fabric as claimed in claim 16 wherein said bottom weft yarns are plied monofilament yarns.

29. A triple-layer papermaking fabric as claimed in claim 16 wherein said top weft yarns are multifilament yarns.

30. A triple-layer papermaking fabric as claimed in claim 16 wherein said bottom weft yarns are multifilament yarns.

31. A triple-layer papermaking fabric as claimed in claim 16 wherein said top weft yarns, said bottom weft yarns, said first warp yarns and said second warp yarns are hydrolysis-resistant polyester yarns.

32. A triple-layer papermaking fabric as claimed in claim 16 wherein said top weft yarns, said bottom weft yarns, said first warp yarns and said second warp yarns are polyamide yarns.

33. A triple-layer papermaking fabric as claimed in claim 16 wherein said bottom weft yarns are polyamide yarns.

* * * * *